United States Patent [19]

Sekimoto et al.

[11] Patent Number: 4,468,434

[45] Date of Patent: Aug. 28, 1984

[54] DYED POLYESTER FIBER COMPOSITE STRUCTURE

[75] Inventors: Masaaki Sekimoto, Nishinomiya; Norihiro Minemura, Takatsuki; Togi Suzuki; Kiyokazu Tsunawaki, both of Matsuyama, all of Japan

[73] Assignee: Teijin Limited, Osaka, Japan

[21] Appl. No.: 411,347

[22] Filed: Aug. 25, 1982

[30] Foreign Application Priority Data

| | | | |
|---|---|---|---|
| Aug. 25, 1981 | [JP] | Japan | 56-132039 |
| Sep. 14, 1981 | [JP] | Japan | 56-143941 |
| Feb. 22, 1982 | [JP] | Japan | 57-26064 |
| Feb. 22, 1982 | [JP] | Japan | 57-26065 |
| May 26, 1982 | [JP] | Japan | 57-87985 |

[51] Int. Cl.[3] ..... D02G 3/00

[52] U.S. Cl. ..... 428/372; 8/115.6; 264/49; 264/78; 264/211; 264/344; 427/385.5; 427/389.9; 427/407.1; 427/412; 428/373; 428/395; 428/398

[58] Field of Search ..... 428/361, 372, 373, 374, 428/375, 395, 376, 398, 421, 422; 8/115.5, 115.6; 264/41, 49, 78, 211, 344; 427/389.9, 385.5, 407.1, 412

[56] References Cited

U.S. PATENT DOCUMENTS

| | | | |
|---|---|---|---|
| 3,546,187 | 12/1970 | Tandy, Jr. | 428/422 X |
| 3,993,834 | 11/1976 | Chimura et al. | 428/422 X |
| 4,004,059 | 1/1977 | Deiner | 428/422 X |
| 4,190,545 | 2/1980 | Marshall et al. | 8/115.6 X |
| 4,219,625 | 8/1980 | Mares et al. | 428/395 X |
| 4,361,617 | 11/1982 | Suzuki et al. | 428/395 X |

*Primary Examiner*—Lorraine T. Kendell

*Attorney, Agent, or Firm*—Burgess, Ryan & Wayne

[57] ABSTRACT

A dyed polyester fiber composite structure having an enhanced brilliance and/or color depth, comprises (A) a dyed porous polyester fiber which has been produced (1) by preparing a polyester resin from a dicarboxylic acid component and a glycol component in the presence of a pore-forming agent containing 0.3 to 3 molar % of at least one phosphorus compound based on the molar amount of the dicarboxylic acid component, (2) by converting the polyester resin to a polyester fiber in which fine particles of the pore-forming agent are dispersed, by treating the polyester fiber with an aqueous alkali solution so that at least 2% of the weight of the fiber is removed and a number of fine pores are formed in the fiber and (4) by dyeing the porous polyester fiber; and (B) a coating layer on the peripheral surface of the dyed porous polyester fiber, comprising a polymeric material having a smaller refractive index than that of the porous polyester fiber.

35 Claims, No Drawings

DYED POLYESTER FIBER COMPOSITE STRUCTURE

FIELD OF THE INVENTION

The present invention relates to a dyed polyester fiber composite structure. More particularly, the present invention relates to a dyed polyester fiber composite structure which comprises a dyed porous polyester fiber substrate and a coating layer, covering the substrate and comprising a polymeric material having a smaller refractive index than that of the substrate, and which exhibits an enhanced brilliance and/or color depth.

BACKGROUND OF THE INVENTION

Textile materials comprising polyester fibers as a principal component are widely used due to their excellent physical and chemical properties. However, polyester fibers are disadvantageous in that when dyed, they exhibit an inferior brilliance and/or color depth compared with dyed natural keratin fibers, for example, wool and silk; dyed cellulosic fibers, for example, cotton and rayon; and acrylic fibers. This is especially disadvantageous for formal apparel. When polyester fiber materials are dyed a deep color, for example, deep black, the depth of the color is unsatisfactory.

Various attempts have been made to eliminate the above-mentioned disadvantage of dyed polyester fiber materials, for example, improvement of dyes to be applied thereto and chemical modification of the polyester to be converted to the fiber material. However, all these the attempts have produced unsatisfactory results.

One attempt tried to improve the dyeing property of the polyester fiber fabric by applying plasma onto the surface of the polyester fiber fabric at 80 to 500 mA.-sec/cm$^2$ so as to finely roughen the surfaces of the polyester fibers in the fabric. In this case, however, only those surfaces of the polyester fibers to which the plasma was applied could be roughened. The other surfaces of the polyester fibers were quite free from the plasma and not roughened. The partially roughened polyester fibers would later rotate around their longitudinal axes, exposing the non-roughened portions and resulting in uneven color depth and/or brilliance of the resultant fabric.

Another attempt tried to improve the dyeing property of the polyester fibers by roughening their surfaces, by incorporating polyoxyethylene glycol or a mixture of polyoxyethylene glycol with sulfonic acid compound into the bodies of the polyester fibers, and then, by treating the incorporated polyester fibers with an aqueous alkali solution. This method is effective for forming a number of fine pores longitudinally extending along the fibers and on the surface of the fibers. The fine pores cause the resultant porous fiber to be hygroscopic.

Still another attempt tried to produce a surface-roughened polyester fiber by preparing a polyester fiber in which fine particles of an inert inorganic substance, for example, zinc oxide or calcium phosphate are distributed, and then by treating the polyester fiber with an aqueous alkali solution so as to form a number of fine pores in the surface layer of the fiber. This type of fiber was also hygroscopic.

Even the two above-mentioned attempts, however, were not effective for enhancing the depth of color of the dyed polyester fiber. Conversely, they sometimes tended to decrease the depth of the color sensed by the naked eye on the dyed polyester fiber.

That is, in the above-mentioned two attempts, if the polyester fibers were insufficiently treated with the aqueous alkali solution, there was no improvement in the color depth of the dyed polyester fiber. Even if the polyester fibers were sufficiently treated with the aqueous alkali solution and so fine pores were formed on the surface layer of the fiber to the desired extent, the pores resulted in diffused reflection of light on the surface of the dyed fiber. This resulted in the reduction in the depth of color sensed by the naked eye of the dyed fiber and caused a pale hue of the dyed fibers. Also, the alkali treatment sometimes causes a significantly decreased mechanical-strength of the polyester fibers and/or an increased the fibril-forming property of the polyester fibers to such an extent that the resultant alkalitreated polyester fibers could not be used in practice.

In a further attempt, polyester fibers containing fine inorganic particles having a size of 80 microns or less, for example, silica particles, and evenly dispersed therein were prepared. They were then treated with an aqueous alkali solution so as to roughen the surface of the fibers to a roughness in the range of from 50 to 200 microns. After dyeing, however, the color depth of the resultant polyester fibers turned out to be similar to that of polyester fibers treated with the aqueous alkali solution but not containing inorganic particles. Even when the surface-roughened polyester fibers were further treated with the aqueous alkali solution, this merely resulted in further reduction of the thickness of the fibers and in further roughening of the surface of the fibers without improving the color depth of the dyed fibers.

Also, in the above-mentioned attempts, it was found that application of a mechanical force, for example, rubbing force, to the roughened surface of the dyed polyester fiber would smooth out the roughened surface, resulting in a different color and glass between the smoothed portion of the fiber surface and the non-smoothed portion of the fiber surface.

Furthermore, the fibril-forming property of the polyester fiber is undesirably enhanced by the presence of the inorganic particles in the fiber.

SUMMARY OF THE INVENTION

An object of the present invention is to provide a dyed polyester fiber composite structure having an enhanced brilliance and/or color depth.

Another object of the present invention is to provide a dyed polyester fiber composite structure having an excellent resistance to rubbing in addition to an enhanced brilliance and/or color depth.

The above objects can be attained by the dyed polyester fiber composite structure of the present invention, which comprises (A) a dyed porous polyester fiber which has been prepared in such a manner that (1) a polyester resin is produced by primarily reacting a dicarboxylic acid component comprising at least terephthalic acid or an ester-forming derivative thereof as a principal ingredient thereof, with a glycol component comprising at least one alkylene glycol having 2 to 6 carbon atoms as a principal ingredient thereof, and then by polycondensing the primary reaction product, in at least one stage of the polyester resin-producing procedures, the reaction mixture being admixed with a pore-forming agent containing 0.3 to 3 molar % of at least one phosphorus compound based on the molar amount of the dicarboxylic acid component, (2) the resultant polyester resin is subjected to a melt-spinning process to provide a polyester fiber in which fine particles of the pore-forming agent are dispersed, (3) the polyester fiber is treated with an aqueous alkali solution to an extent that at least 2% of the weight of the polyester fiber is dissolved in the aqueous alkali solution, whereby a number of pores are formed in the polyester fiber and, then, (4) the resultant porous polyester fiber is dyed; and (B) a coating layer formed on the peripheral surface of the dyed porous polyester fiber and comprising a polymeric material having a smaller refractive index than that of the porous polyester fiber.

The pore-forming agent usable for producing the dyed polyester fiber composite structure may comprise at least one member selected from the group consisting of:

(a) a mixture of at least one pentavalent phosphorus compound in an amount of 0.3 to 3 molar % based on the molar amount of the dicarboxylic acid component and at least one calcium compound which is in an amount of 1 mole to 1.7 moles per mole of the pentavalent phosphorus compound and which has not been preliminarily reacted with the pentavalent phosphorus compound;

(b) a mixture of at least one trivalent phosphorus compound in an amount of 0.3 to 3 mole % based on the molar amount of the dicarboxylic acid component and at least one alkaline earth metal compound which is in an amount of 1 mole to 1.7 moles per mole of the trivalent phosphorus compound and which has not been preliminarily reacted with the trivalent phosphorus compound;

(c) a mixture of 0.3 to 3 molar % based on the molar amount of the dicarboxylic acid component, of at least one phosphorus compound of the formula (I):

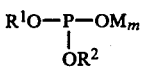

(I)

wherein $R^1$ and $R^2$ represent, independently from each other, a member selected from the group consisting of a hydrogen atom and monovalent organic radical, M represents a member selected from the group consisting of alkali metals and alkaline earth metals, and m represents 1 when M represents an alkali metal and ½ when M represents an alkaline earth metal, and at least one alkaline earth metal compound which is in an amount of 0.5 to 1.2 moles per mole of the phosphorus compound of the formula (I) and which has not been preliminarily reacted with the phosphorus compound of the formula (I);

(d) a mixture of an ingredient (i) consisting of at least one member selected from the group consisting of isophthalic acid compounds having an alkali metal sulfonate radical and ester-forming derivatives thereof, which ingredient (i) is in an amount of 0.5 to 10 molar % based on the molar amount of the dicarboxylic acid component, an ingredient (ii) consisting of at least one phosphorus compound of the formula (II):

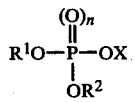

(II)

wherein $R^1$ and $R^2$ represent, independently from each other, a member selected from the group consisting of a hydrogen atom and monovalent organic radicals, X represents a member selected from the group consisting of a hydrogen atom, monovalent organic radicals and monovalent metal atoms, and n represents 0 or 1, in an amount of 0.3 to 3 molar % based on the molar amount of said dicarboxylic acid component, and an ingredient (iii) consisting of at least one lithium compound in such an amount that the sum of the equivalent numbers of the metals contained in the above-mentioned ingredients (ii) and (iii) is in the range of from 2.0 times to 3.2 times the molar amount of the phosphorus compound in ingredient (ii), the ingredients (i), (ii), and (iii) having not been preliminarily reacted with each other; and (e) a mixture of 0.5 to 3 molar % based on the molar amount of the dicarboxylic acid component, of at least one phosphorus compound of the formula (III):

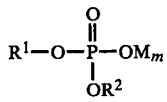

(III)

wherein $R^1$ and $R^2$ represent, independently from each other, a member selected from the group consisting of a hydrogen atom and monovalent organic radicals, M represents a member selected from the group consisting of alkali metals and alkaline earth metals, an m represents 1 when M represents an alkali metal and ½ when M represents an alkaline earth metal, and at least one alkaline earth metal compound which is in an amount of 0.5 to 1.2 moles per mole of the phosphorus compound of the formula (III) and which has not been preliminarily reacted with the phosphorus compound of the formula (III).

DETAILED DESCRIPTION OF THE INVENTION

The dyed polyester fiber composite structure of the present invention comprises a substrate consisting of a dyed porous polyester fiber and a polymeric coating layer, formed on the peripheral surface of the dyed porous polyester fiber substrate and having a smaller refractive index than that of the porous polyester fiber substrate.

In the present invention, it is essential that the dyed porous polyester fiber be prepared (1) by producing a polyester resin in such a manner that a dicarboxylic acid component comprising at least terephthalic acid or an ester-forming derivative thereof as a principal ingredient thereof is primarily reacted with a glycol component comprising at least one alkylene glycol having 2 to 6 carbon atoms as a principal ingredient thereof, and then the primary reaction product is poly-condensed, in at least one stage of the polyester resin-producing procedures, the reaction mixture being admixed with a pore-forming agent containing 0.3 to 3 molar % of at least one phosphorus compound based on the molar amount of the dicarboxylic acid component;

(2) by subjecting the resultant polyester resin to a melt-spinning process to provide a polyester fiber in which fine particles of the pore-forming agent are dispersed;

(3) by treating the polyester fiber with an aqueous alkali solution to an extent that at least 2% of the weight of the polyester fiber is dissolved in said aqueous alkali solution, whereby a number of pores are formed in the polyester fiber; and, then, (4) by dying the resultant porous polyester fiber.

In the preparation of the polyester resin, the dicarboxylic acid component comprising, as a principal ingredient, at least one member selected from terephthalic acid and ester-forming derivatives of the terephthalic acid, is primarily reacted with a glycol component comprising, as a principal ingredient, at least one alkylene glycol having 2 to 6 carbon atoms, selected from, for example, ethylen glycol, trimethylene glycol, tetramethylene glycol, pentamethylene glycol, and hexamethylene glycol, preferably, ethylene glycol and tetramethylene glycol.

The dicarboxylic acid component may contain a small amount of additional ingredients consisting of at least one difunctional carboxylic acid different from terephthalic acid, in addition to the principal ingredient. The addition difunctional acid may be selected from aromatic, aliphatic, and cycloaliphatic difunctional carboxylic acids, for example, isophthalic acid, naphthalene dicarboxylic acids, diphenyl dicarboxylic acids, diphenoxyethane dicarboxylic acids, β-hydroxyethoxybenzoic acid, p-hydroxybenzoic acid, 5-sulfoisophthalic acid, adipic acid, sebacic acid, and 1,4-cyclohexane dicarboxylic acid.

The glycol component may contain, in addition to the principal ingredient thereof, a small amount of an additional ingredient consisting of at least one member selected from diol compounds different from the specified alkylene glycols and polyoxyalkylene glycols. The additional ingredient for the glycol component may be selected from aromatic, aliphatic, and cycloaliphatic diol compounds and polyoxyalkylene glycol compounds, for example, cyclohexane-1,4-dimethanol, neopentyl glycol, bis-phenol A, and bis-phenol S.

The polymerization procedure for producing the polyester resin can be carried out in any conventional manner. For example, in the case of the preparation of polyethylene terephthalate resin, (1) terephthalic acid is directly esterified with ethylene glycol or terephthalic acid is converted to a lower alkyl terephthalate, for example, dimethyl terephthalate, and then the lower alkyl terephthalate is subjected to an ester interchange reaction with ethylene glycol; and thereafter, (2) the resultant terephthalic ethylene glycol ester or its prepolymer is poly-condensed at an elevated temperature under a reduced pressure to produce polyethylene terephthalate having a desired degree of polymerization.

In at least one stage of the polyester resin-producing procedures, the reaction mixture is admixed with a pore-forming agent containing 0.3 to 3 molar %, preferably, 0.6 to 2 molar %, of at least one phosphorus compound based on the molar amount of the dicarboxylic acid component.

If the amount of the pore-forming agent admixed with the reaction mixture contains more than 3 molar % of the phosphorus compound based on the molar amount of the dicarboxylic acid component, the rate of polycondensation of the reaction mixture is decreased, the softening point and degree of polymerization of the resultant polyester resin are decreased, and a number of coarse particles of the pore-forming agent are formed in the resultant polyester resin. The above-mentioned phenomena complicate the melt-spinning procedure for producing the polyester fiber due to frequent breakage of fibers and causes the resultant polyester fiber to exhibit poor resistance to abrasion.

If the amount of the pore-forming agent admixed into the reaction mixture contains less than 0.3 molar % of the phosphorus compound based on the molar amount of the dicarboxylic acid component, the resultant dyed polyester fiber composite structure exhibits an unsatisfactory brilliance and/or color depth.

In the polyester resin-producing procedure, it is preferable that at least 80% by weight of the pore-forming agent be admixed to the reaction mixture after the primary reaction is substantially completed but before the intrinsic viscosity of the reaction mixture in the polycondensation step reaches 0.3. This feature is effective for smoothly carrying out the primary reaction procedure without decreasing the rate of the primary reaction, for preventing formation of coarse particles of the pore-forming agent, and/or for preventing undesirable bumping phenomenon of the reaction mixture, especially, during the ester-interchange procedure.

The pore-forming agent preferably comprises at least one member selected from the group consisting of:

(a) a mixture of at least one pentavalent phosphorus compound in an amount of 0.3 to 3 molar % based on the molar amount of the dicarboxylic acid component and at least one calcium compound which is in an amount of 1 mole to 1.7 moles per mole of the pentavalent phosphorus compound and which has not been preliminarily reacted with the pentavalent phosphorus compound;

(b) a mixture of at least one trivalent phosphorus compound in an amount of 0.3 to 3 mole % based on the molar amount of the dicarboxylic acid component and at least one alkaline earth metal compound which is in an amount of 1 mole to 1.7 moles per mole of the trivalent phosphorus compound and which has not been preliminarily reacted with the trivalent phosphorus compound;

(c) a mixture of 0.3 to 3 molar % based on the molar amount of the dicarboxylic acid component, of at least one phosphorus compound of the formula (I):

$$R^1O-\underset{\underset{OR^2}{|}}{P}-OM_m \qquad (I)$$

wherein $R^1$ and $R^2$ represent, independently from each other, a member selected from the group consisting of a hydrogen atom and monovalent organic radical, M represents a member selected from the group consisting of alkali metals and alkaline earth metals, and m represents 1 when M represents an alkali metal and ½ when M represents an alkaline earth metal, and at least one alkaline earth metal compound which is in an amount of 0.5 to 1.2 moles per mole of the phosphorus compound of the formula (I) and which has not been preliminarily reacted with the phosphorus compound of the formula (I);

(d) a mixture of an ingredient (i) consisting of at least one member selected from the group consisting of isophthalic acid compounds having an alkali metal sulfonate radical and ester-forming derivatives thereof and in an amount of 0.5 to 10 molar % based on the molar amount of the dicarboxylic acid component, an ingredient (ii) consisting of at least one phosphorus compound of the formula (II):

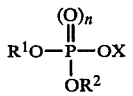

(II)

wherein $R^1$ and $R^2$ represent, independently from each other, a member selected from the group consisting of a hydrogen atom and monovalent organic radicals, X represents a member selected from the group consisting of a hydrogen atom, monovalent organic radicals, and monovalent metal atoms, and n represents 0 or 1, in an amount of 0.3 to 3 molar % base on the molar amount of said dicarboxylic acid component, and an ingredient (iii) consisting of at least one lithium compound in such an amount that the sum of the equivalent numbers of the metals contained in the above-mentioned ingredients (ii) and (iii) is in the range of from 2.0 times to 3.2 times the molar amount of the phosphorus compound in ingredient (ii), the ingredients (i), (ii), and (iii) having not been preliminarily reacted with each other; and (e) a mixture of 0.5 to 3 molar % based on the molar amount of the dicarboxylic acid component, of at least one phosphorus compound of the formula (III):

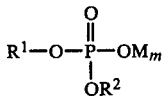

(III)

wherein $R^1$ and $R^2$ represent, independently from each other, a member selected from the group consisting of a hydrogen atom and monovalent organic radicals, M represents a member selected from the group consisting of alkali metals and alkaline earth metals, and m represents 1 when M represents an alkali metal and ½ when M represents an alkaline earth metal, and at least one alkaline earth metal compound which is in an amount of 0.5 to 1.2 moles per mole of the phosphorus compound of the formula (III) and which has not been preliminarily reacted with the phosphorus compound of the formula (III).

In the mixture (a) for the pore-forming agent, the pentavalent phosphorus compound is not limited to a specific type of phosphorus compound so long as it is pentavalent and is free from metallic atoms. For example, the pentavalent phosphorus compound may be selected from the group consisting of phosphoric acid, phosphoric mono-, di-, and tri-esters, condensed phosphoric acids, esters of the condensed phosphoric acids, and reaction products of the above-mentioned pentavalent phosphorus compound with ethylene glycol and/or water. The phosphoric esters include triethyl phosphate, tributyl phosphate, triphenyl phosphate, methyl acid phosphate, ethyl acid phosphate, and butyl acid phosphate. The condensed phosphoric acids include pyrophosphoric acid, metaphosphoric acid, and polyphosphoric acid.

The preferable pentavalent phosphorus compounds are phosphoric acid, phosphoric triesters, and phosphoric mono- and -di esters.

The calcium compound usuable for the mixture (a) is selected from the group consisting of organic carboxylic calcium salts, inorganic calcium salts, calcium halides, calcium chelate compounds, calcium hydroxide, calcium oxide, calcium alcoholates, and calcium phenolate. The organic carboxylic calcium salts include calcium salts of acetic acid, oxalic acid, benzoic acid, phthalic acid, and stearic acid. The inorganic calcium salts include calcium salts of boric acid, surfuric acid, silicic acid and carbonic acid, and calcium bicarbonate. The calcium halides include calcium chloride. the calcium chelate compounds include calcium salt of ethylene diamine tetraacetic acid. The calcium alcoholates include calcium methylate, ethylate, and glycolates. The preferable calcium compounds are organic carboxylic calcium salts, calcium halides, calcium chelate compounds, and calcium alcoholates which are soluble in ethylene glycol. The more preferable calcium compounds are organic carboxylic calcium salts soluble in ethylene glycol. The above-mentioned calcium compound may be used in single species or in combination of two or more different species.

In the mixture (a) for the pore-forming agent, the pentavalent phosphorus compound is used in an amount of 0.3 to 3 molar % based on the molar amount of the dicarboxylic acid component and the calcium compound is used in an amount of 1 mole to 1.7 moles, preferably, 1.1 moles to 1.5 moles, per mole of the pentavalent phosphorus compound. When the amount of the calcium compound is less than 1.0 mole, sometimes the resultant dyed polyester fiber composite structure exhibits an unsatisfactory brilliance and/or color depth. Also, when the calcium compound is used in an amount of more than 1.7 moles, the resultant polyester resin contains coarse particles consisting of a calcium salt of polyester oligomer and the coarse particles cause the resultant dyed polyester fiber composite structure to exhibit an unsatisfactory brilliance and/or color depth when observed by the naked eye.

In the mixture (a), it is important that the calcium compound not be preliminarily reacted with the pentavalent phosphorus compound before the mixture (a) is admixed with the reaction mixture. This feature is effective for allowing the pentavalent phosphorus compound to react with the calcium compound within the reaction mixture so as to produce superfine particles of an insoluble reaction product uniformly dispersed in the resultant polyester resin. If a reaction product of the phosphous compound with the calcium compound is added to the reaction mixture, it is very difficult to finely divide the reaction product in the reaction mixture. Therefore, the resultant polyester contains coarse particles of the reaction product which cause the melt-spinning procedure of the polyester resin to be difficult and the resultant dyed polyester fiber composite structure to exhibit an unsatisfactory brilliance and/or color depth.

The pore-forming agent consisting of the mixture (a) is added to the reaction mixture in any stage of the polyester resin-producing procedure. This addition may be carried out either in a single operation or in two or more operations. Some types of the calcium compounds have a catalytic activity for the ester-interchange reaction. When the pore-forming agent contains this type of calcium compound, the pore-forming agent may be added to the reaction mixture before the primary reaction so as to catalytically promote the primary reaction. However, sometimes, the addition of the pore-forming agent into the primary reaction mixture causes undesirable bumping of the reaction mixture. Therefore, it is preferable that the amount of the calcium compound to be added to the primary reaction be limited to 20% or less based on the entire weight of the calcium compound to be used during the polyester resin-producing procedures.

In the mixture (b) for the pore-forming agent, the trivalent phosphorus compound is not limited to a specific type of phosphorus compound so long as it is trivalent and contains no metallic atoms. For example, the trivalent phosphorus compound is selected from the group consisting of phosphorus acid, phosphorous mono-, di-, and tri-esters, and reaction products of the above-mentioned trivalent phosphorus compounds with ethylene glycol and/or water. The phosphorous esters may be selected from trimethyl phosphite, triethyl phosphite, tributyl phosphite, triphenyl phosphite, methyl acid phosphite, ethyl acid phosphite, and butyl acid phosphite. The preferable trivalent phosphorus compounds for the mixture (b) are phosphorous acid, phosphorous triesters, phosphorous diesters, and phosphorous monoesters.

In the mixture (b), the alkaline earth metal compound is selected from the group consisting of alkaline earth metal salts of organic carboxylic acid and of inorganic acids, and halides, chelate compounds, hydroxides, oxides, alcoholates, and phenolates of alkaline earth metals. The alkaline earth metal salts of organic carboxylic acids may be selected from magnesium, calcium, strontium, and barium salts of acetic acid, oxalic acid, benzoic acid, phthalic acid, and steraric acid. The alkaline earth metal salts of inorganic acids include magnesium, calcium, strontium, and barium salts of boric acid, sulfuric acid, silicic acid, carbonic acid, and bicarbonic acid. The halides include magnesium, calcium, strontium, and barium chlorides. The chelate compounds include magnesium-, calcium-, strontium-, and barium-chelated compounds of ethylene diamine tetracetic acid. The alcoholate compounds may be selected from methylates, ethylates, and glycolates of magnesium, calcium, strontium, and barium. The preferable alkaline earth metal compounds for the mixture (b) are organic carboxylic salts, halides, chelate compounds and alcoholates of magnesium, calcium, strontium, and barium, which are soluble in ethylene glycol. More preferable alkaline earth metal compounds are the organic carboxylic salts of magnesium, calcium, strontium, and barium.

The alkaline earth metal compound may be used either in a single species or in combination of two or more species thereof.

In the mixture (b), the trivalent phosphorus compound is used in an amount of 0.3 to 3 molar %, preferably, 0.5 to 3 molar %, more preferably, 0.6 to 2 molar %, based on the molar amount of the dicarboxylic acid component, and the alkaline earth metal component is used in an amount of 1 mole to 1.7 moles, preferably, 1.1 moles to 1.5 moles, per mole of the trivalent phosphorus compound.

If the amount of the alkaline earth metal compound is less than 1.0 mole per mole of the trivalent phosphorus compound, sometimes the rate of the polycondensation reaction is decreased, the degree of polymerization and the softening point of the resultant polyester resin are decreased, and/or the resultant dyed polyester fiber composite structure exhibits an unsatisfactory brilliance and/or color depth.

Also when the alkaline earth metal compound is used in an amount of more than 1.7 times the molar amount of the trivalent phosphorus compound, the resultant polyester resin contains coarse particles consisting of an alkaline earth metal salt of polyester oligomer. The coarse particles cause the resultant dyed polyester fiber composite structure to exhibit an unsatifactory brilliance and/or color depth when observed by the naked eye. Also, the excessive amount of the alkaline earth metal compound promotes the thermal decomposition of the polyester resin. This phenomenon results in discoloration of the polyester resin into yellow brown.

In the mixture (b), it is important that the alkaline earth metal compound and the trivalent phosphorus compound not be reacted with each other before the mixture (b) is admixed into the reaction mixture. This feature is highly effective for forming superfine particles of the pore-forming agent uniformly dispersed in the reaction mixture and then, in the resultant polyester resin, and for producing the dyed polyester fiber composite structure having the enhanced brilliance and/or color depth.

The pore-forming agent consisting of the mixture (b) can be added to the reaction mixture in any stage of the polyester resin-producing procedures, either in a single operation or in two or more operations.

Some types of alkaline earth metal compounds exhibit catalytic activity for the ester interchange reaction. In this case, the pore-forming agent consisting of the mixture (b) can promote the ester interchange reaction. However, it is preferable to limit the amount of the alkaline earth metal compound to be added into the reaction mixture before or during the primary reaction, to 20% or less based on the entire weight of the alkaline earth metal compound to be used during the polyester resin-producing procedures. This feature is effective for preventing undesirable bumping phenomenon of the reaction mixture.

In the mixture (c) for the pore-forming agent, the phosphorus compound of the formula (I) is used in an amount of 0.3 to 3 molar %, preferably, 0.6 to 2 molar %, based on the molar amount of the dicarboxylic acid compound, and the alkaline earth metal compound is used in amount of from 0.5 to 1.2 moles, preferably, 0.5 to 1.0 mole, per mole of the phosphorus compound of the formula (I).

In the formula (I):

$$R^1O-\underset{\underset{OR^2}{|}}{P}-OM_m, \qquad (I)$$

the monovalent organic radical represented by $R^1$ or $R^2$ may be selected from the group consisting of alkyl radicals, aryl radicals, aralkyl radicals, and radicals of the formula:

$$-\!\!\left(CH_2\right)_l O\!\!\right)_k R^3$$

wherein $R^3$ represents a member selected from the group consisting of a hydrogen atom, alkyl radicals, aryl radicals, and aralkyl radicals, l is an integer of 2 or more, and k is an integer of 1 or more.

The alkali metals and alkaline earth metals represented by M in the formula (I), include lithium, sodium, potassium, magnesium, calcium, strontium, and barium. The preferable metals are calcium, strontium, and barium. In the formula (I), when M represents an alkali metal, m represents 1 and when M represents an alkaline earth metal, m represents $\frac{1}{2}$.

In the phosphorus compound of the formula (I), it is important that only one radical represented by $-OM_m$ contain metallic atoms and that the other radicals, $-OR^1$ and $-OR^2$, contain no metallic atoms. If the radical $R^1$ and/or $R^2$ is substituted by an alkali or alkaline earth metal atom, the resultant pre-forming agent causes the size of the pores formed in the polyester fiber to be excessively large and the resultant dyed polyester fiber to exhibit an unsatisfactory brilliance and/or color depth and a poor resistance to fibril-formation and abrasion.

The phosphorus compounds of the formula (I) can be produced by reacting phoshorous acid or a phoshorous tri-, di-, or mono-ester with an alkali or alkaline earth metal compound in a reaction medium at an elevated temperature. The reaction medium preferably consists of the same alkylene glycol as that to be used for producing the polyester resin.

The alkaline earth metal compounds usable for the mixture (c) may be the same as those usable for the mixture (b).

In the mixture (c), it is also important that the phosphorus compound of the formula (I) and the alkaline earth metal compound be added to the reaction mixture before they are reacted to each other. This feature is greatly effective for forming superfine particles of the pore-forming agent evenly dispersed in the reaction mixture and then, in the resultant polyester resin, and also, for enhancing the brilliance and/or color depth of the dyed polyester fiber composite structure.

The pore-forming agent consisting of the mixture (c) may be added to the reaction mixture at any stage of the polyester resin-producing procedure, either in a single adding operation or in two or more adding operations.

As described hereinbefore, in the case where an alkaline earth metal compound contained in the mixture (c) has a catalytic activity for the ester interchange reaction, it is preferable that the amount of the alkaline earth metal compound to be added to the reaction mixture before or during the primary reaction be limited to 20% or less based on the entire amount of the alkaline earth metal compound to be used during the polyester resin-producing procedure, in order to prevent the undesirable bumping phenomenon of the reaction mixture.

The mixture (d) for the pore-forming agent consists of:

(i) an ingredient consisting of at least one member selected from the group consisting of isophthalic acid compounds having an alkali metal sulfonate radical and ester-forming derivatives thereof, which ingredient (i) is in an amount of 0.5 to 10 molar % based on the molar amount of said dicarboxylic acid component;

(ii) an ingredient consisting of at least one phosphorus compound of the formula (II):

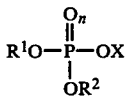

(II)

wherein $R^1$ and $R^2$ represent, independently from each other, a member selected from the group consisting of a hydrogen atom and monovalent organic radicals, X represents a member selected from the group consisting of a hydrogen atom, monovalent organic radicals, and monovalent metal atoms, and n represents 0 or 1, in an amount of 0.3 to 3 molar % based on the molar amount of said dicarboxylic acid component; and (iii) an ingredient consisting of at least one lithium compound in such a amount that the sum of the equivalent numbers of the metals contained in the above-mentioned ingredients (ii) and (iii) is in the range of from 2.0 times to 3.2 times the molar amount of the phosphorus compound in ingredient (ii).

In the mixture (d), the alkali metal sulfonate radical-containing isophthalic acid compounds and ester-forming derivatives thereof are selected preferably from the group consisting of sodium 3,5-di(carboxy) benzene sulfonate, lithium 3,5-di(carboxy) benzene suofonate, potassium 3,5-di(carboxy) benzene sulfonate, lithium 3,5-di(carbomethoxy) benzene sulfonate, potassium 3,5-di(carbomethoxy) benzene sulfonate, sodium 3,5-di(β-hydroxyethoxycarbony) benzene sulfonate, lithium 3,5-di(β-hydroxyethoxycarbonyl) benzene sulfonate, potassium 3,5-di(β-hydroxyethoxycarbonyl) benzene sulfonate, sodium 3,5-di(γ-hydroxypropoxycarbonyl) benzene sulfonate, sodium 3,5-di(δ-hydroxybutoxycarbonyl) benzene sulfonate, and lithium 3,5-di(δ-hydroxybutoxycarbonyl) benzene sulfonate.

The ingredient (i) in the mixture (d) is used in an amount of 0.5 to 10 molar %, preferably, 1 to 6 molar % based on the entire molar amount of the dicarboxylic acid component in the reaction mixture. When the amount of the ingredient (i) is less than 0.5 molar % based on the entire molar amount of the dicarboxylic acid component, the resultant polyester fiber exhibits an unsatisfactory dyeing property for cationic dyes. The dyeing property for the cationic dyes of the polyester fiber reaches a maximum when the amount of the ingredient (i) reaches about 10 molar % based on the entire molar amount of the dicarboxylic acid component. Therefore, an additional amount of the ingredient (i) above 10 molar % is not effective for enhancing the dyeing property fiber and, also, causes the resultant polyester fiber to exhibit inferior chemical and/or physical properties to the regular polyester fiber.

The ingredient (ii) consists of at least one phosphorus compound of the formula (II). In the formula (II), $R^1$ and $R^2$ represent a hydrogen atom or a monovalent organic radical. The monovalent organic radical may be selected from alkyl radicals, aryl radicals, aralkyl radicals, and radicals of the formula $\text{-}(CH_2)_l\text{-}O\text{-}_k R^3$ wherein $R^3$, l, and k are as defined above. In the formula (II), X represents a hydrogen atom, a monovalent organic radical which may be the same as the monovalent organic radical represented by $R^1$ and/or $R^2$ in the formula (II), or a monovalent metallic atom which is preferably selected from alkali metal atoms and alkaline earth metal atoms, more preferably, lithium atom.

The phosphorus compound of the formula (II) is preferably selected from the group consisting of phosphoric acid, mono-, di-, and tri-esters of phosphoric acid, phosphorous acid, mono-, di-, and tri-esters of phosphorous acid, reaction products of the above-mentioned phosphorus compounds with glycols and/or water, and reaction products of equimolar amounts of the above-mentioned phosphorus compound of with lithium compounds.

The phosphoric esters include trimethyl phosphate, triethyl phosphate, tributyl phosphate, triphenyl phosphate, methyl acid phosphate, ethyl acid phosphate, and butyl acid phosphate.

The phosphorous esters include trimethyl phosphite, triethyl phosphite, tributyl phosphite, triphenyl phosphite, methyl acid phosphite, ethyl acid phosphite, and butyl acid phosphite.

The lithium compound for the ingredient (iii) is preferably selected from the group consisting of lithium salts of organic carboxylic acids and of inorganic acids, and halides, chelate compounds, hydroxides, oxides, alcholates, and phenolates of lithium.

The lithium salts of organic carboxylic acids include lithium salts of acetic acid, oxalic acid, benzoic acid, phthalic acid, and stearic acid. The lithium salts of inorganic acids include lithium borate, sulfate, silicate, carbonate, and bicarbonate. The lithium halide is preferably lithium chloride. The lithium chelate compound may be, for example, lithium-chelated ethylenediamine tetraacetic acid complex. The lithium alcoholates include lithium methylate, ethylate, and glycolate.

The preferable lithium compounds for the ingredient (iii) are the organic carboxylic acids salts, halides, chelate compounds, and alcoholates of lithium, which are soluble in ethylene glycol. More preferable lithium compounds are the organic carboxylic acid salts of lithium.

In the mixture (d), it is important that the ingredients (i), (ii), and (iii) have not been preliminarily reacted with each other, for the same reasons as with the mixtures (a), (b), and (c).

The mixture (e) for the pore-forming agent comprises 0.5 to 3 molar %, preferably, 0.6 to 2 molar %, based on the molar amount of said dicarboxylic acid component, of at least one phosphorus compound of the formula (III):

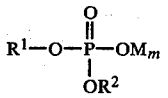

(III)

wherein $R^1$ and $R^2$ represent, independently from each other, a member selected from the group consisting of a hydrogen atom and monovalent organic radicals, M represents a member selected from the group consisting of alkali metals and alkaline earth metals, and m presents 1 when M represents an alkali metal and $\frac{1}{2}$ when M represents an alkaline earth metal, in combination with at least one alkaline earth metal compound which is in an amount of 0.5 to 1.2 moles, preferably, 0.5 to 10 moles per mole of said phosphorus compound of the formula (III).

In the formula (III), the monovalent organic radical represented by $R^1$ or $R^2$ may be selected from the group consisting of alkyl radicals, aryl radicals, aralkyl radicals, and radicals of the formula $\text{-}[(CH_2)_l\text{-}O]_k R^3$, wherein $R^3$ represents a member selected from the group consisting of alkyl radicals, aryl radicals, and aralkyl radicals, l is an integer of 2 or more, and k is an integer of 1 or more.

The alkali metals and alkaline earth metals represented by M in the formula (III) include lithium, sodium potassium, magnesium, calcium, strontium, and barium. The preferable metals are calcium, strontium, and barium. In the formula (III), when M represents an alkali metal atom, m represents 1 and when M represents an alkaline earth metal atom, m represents $\frac{1}{2}$.

In the phosphorus compound of the formula (III), it is important that only one radical represented by $-OM_m$ contain metallic atoms and the other radicals, $-OR^1$ and $-OR^2$, contain no metallic atoms. If the radical $R^1$ and/or $R^2$ is substituted by an alkali or alkaline earth metal atom, the resultant pore-forming agent causes the size of the pores formed in the polyester fiber to be excessively large and the resultant dyed polyester fiber to exhibit an unsatisfactory brilliance and/or color depth and a poor resistance to abrasion and fibril-formation.

The phosphorus compound of the formula (III) can be produced by reacting phosphoric acid or a phosphoric tri-, di-, or mono-ester with an alkali or alkaline earth metal compound in a reaction medium at an elevated temperature. In this case, the reaction medium preferably consists of the same alkylene glycol as that to be used for producing the polyester resin.

The alkaline earth metal compounds usable for the mixture (e) may be the same as those usable for the mixture (b) or (c).

In the mixture (e), it is important that the phosphorus compound of the formula (III) and the alkaline earth metal compound have not been preliminarily reacted with each other before the mixture (e) is added to the reaction mixture, for the same reasons as those described hereinbefore.

In the mixture (e), the alkaline earth metal compound is used in a limited amount of 0.5 to 1.2 moles, preferably, 0.5 to 1.0 moles, per mole of the phosphorus compound of the formula (III). If the amount of the alkaline earth metal compound is less than 0.5 moles per mole of the phosphorus compound of the formula (III), sometimes the rate of the polymerization reaction is decreased, the degree of polymerization and the softening point of the resultant polyester resin are decreased, and/or the resultant dyed polyester fiber composite structure exhibits an unsatisfactory brilliance and/or color depth.

If the amount of the alkaline earth metal compound in the mixture (e) is 1.2 moles or more per mole of the phosphorus compound of the formula (III), a number of coarse particles consisting of an alkaline earth metal salt of polyester oligomer are formed in the polyester resin. The coarse particles result in unsatisfactory brilliance and/or color depth of the dyed polyester fiber composite structure when observed by the naked eye.

The pore-forming agent consisting of the mixture (e) can be added to the reaction mixture in any stage of the polyester resin-producing procedure, either in a single adding operation or in two or more adding operations.

When the alkaline earth metal compound contained in the mixture (e) has a catalytic activity for the ester interchange reaction, it is preferable that the amount of the alkaline earth metal compound to be added to the reaction mixture before or during the primary reaction be limited to 20% or less of the entire weight of the alkaline earth metal compound to be used during the polyester resin-producing procedures, so as to prevent the undesirable bumping phenomenon of the reaction mixture. The polyester resin containing the specific pore-forming agent is subjected to a melt-spinning process so as to produce a polyester fiber in which fine particles of the pore-forming agent are uniformly dispersed.

The polyester fiber may be either of a regular type or of a hollow type. Also, the polyester fiber may have a regular cross-sectional profile or an irregular cross-sectional profile. Furthermore, the polyester fiber may be of a core-in-sheath type in which the sheath is composed of a pore-forming agent-containing polyester resin and the core is composed of a polyester resin free from the pore-forming agent, or of a multilayer type in which at least one outer layer is composed of a pore-forming agent-containing polyester resin.

The melt-spun polyester fiber may be drawn, heat treated, textured, and/or converted into a yarn or fabric before treatment by aqueous alkali.

It is preferable that the polyester fiber contain 0.1% to 5% by weight of fine particles of the pore-forming agent having an average size of primary particle smaller than 100 millimicrons and that the number of secondary aggregate particles of the pore-forming agent, having a size of 100 millimicrons or more, be not more than 3 per 10 square microns of the cross-sectional area of the fiber. This feature is effective for forming an extremely finely roughened surface on the polyester fiber. The roughness of the surface is smaller than the wavelength of visible rays and, therefore, the resultant dyed polyester fiber composite structure can exhibit an excellent brilliance and/or color depth and a superior resistance to fibril-formation.

The term "secondary aggregate particle" refers to a particle consisting of a plurality of primary particles, the distances between the centers of the primary particles adjacent to each other being smaller than the average diameter of the primary particles.

The secondary aggregate particles can be determined by an electron microscope at a magnification at which the size of the primary particles can be measured.

The primary particles of the pore-forming agent preferably has a size of 50 microns or less, more preferably, 30 microns or less. Also, it is more preferable that the number of the secondary aggregate particles of the pore-forming agent be less than one per 10 square microns of the cross-sectional area of the fiber.

The polyester fiber may contain, in addition to the pore-forming agent, at least one additive, for example, a catalyst, discoloration preventing agent, heat resistant-improving agent, flame retardant, optical brightening agent, delustering agent, or coloring agent.

The polyester fiber is converted to a porous polyester fiber by treating it with an aqueous alkali solution to an extent that at least 2%, preferably, from 2% to 50%, of the original weight of the polyester fiber is dissolved in the alkali solution.

The aqueous alkali solution preferably contains 0.01% to 40% by weight, more preferably, 0.1% to 30% by weight, of at least one member selected from the group consisting of sodium hydroxide, potassium hydroxide, tetramethyl-ammonium hydroxide, sodium carbonate, and potassium carbonate. The most preferable alkali compounds are sodium hydroxide and potassium hydroxide.

Usually, the aqueous alkali solution treatment is carried out at a temperature of from room temperature to 130° C., for a treatment time of from one minute to 4 hours.

As a result of the aqueous alkali treatment, a number of fine pores are formed in the polyester fiber. The fine pores are preferably oriented in the direction of the longitudinal axis of the polyester fibers. Also, it is preferable that when the width of the pores is measured in the direction at right angles to the longitudinal axis of the fiber and a frequency in distribution of the values of the measured width of the pores is determined, the width of the pores having the largest distribution frequency thereof be in the range of from 0.1 to 0.5 microns, and when the length of the pores is measured in a direction parallel to the longitudinal axis of the fiber and a frequency in distribution of the values of the measured length of the pores is determined, the length of the pores having the largest distribution frequency thereof be in the range of from 0.2 to 5 microns.

Also, the porous polyester fibers may have a number of pores located at least in the peripheral surface layer thereof having a thickness of at least 5 microns, which pores are oriented along the longitudinal axis of the fibers and are connected to each other, the size of the pores having the largest distribution frequency thereof being in the range of from 0.1 to 0.5 microns.

The porous polyester fiber is dyed with a usual dye, for example, disperse dye or cationic dye, in a usual dyeing manner.

The dyed porous polyester fiber is used as a substrate of the dyed polyester fiber composite structure of the present invention.

The peripheral surface of the dyed polyester fiber structure is coated with a coating layer comprising a polymeric material having a smaller refractive index than that of the porous polyester fiber.

Usually, it is preferable that the coating layer exhibit a refractive index in the range of from 1.2 to 1.4 and being smaller than that of the porous polyester fiber.

The coating layer usually comprises a polymeric material consisting of at least one member selected from the group consisting of fluorine-containing polymers, silicon-containing polymers, ethylene-vinyl acetate copolymers, polyacrylic and polymethacrylic esters, and polyurethanes.

The fluorine-containing polymer may be selected from the group consisting of polytetrafluoroethylene, tetrafluoroethylene-propylene copolymers, tetrafluoroethylene-hexafluoropropylene copolymers, tetrafluoroethylene-ethylene copolymers, tetrafluoroethylene-tetrafluoropropylene copolymers, polyfluorovinylidene, polypentadecafluorooctyl acrylate, polyfluoroethylacrylate, polytrifluoro-isopropyl methacrylate, and polytrifuloroethyl methacrylate.

The silicon-containing polymer may be selected from the group consisting of polydimethylsilane, polymethylhydrodiene siloxane, and polydimethyl siloxane.

The polyacrylic and polymethacrylic esters may be selected from the group consisting of polyethyl acrylate, and polyethyl methacrylate, respectively.

In the formation of the coating layer, it is preferable that the polymeric coating material be selected so that the resultant coating layer exhibits a refractive index as small as possible compared to that of the porous polyester fiber substrate.

The coating layer may be formed by applying a solution or emulsion containing the polymeric material to the dyed porous polyester fiber by a conventional coating method, for example, spraying method, padding method, kiss roll coating method, knife coating method, pad-roll coating method, gravure coating method, and absorption in liquid method.

The coated layer of the solution or emulsion containing the polymeric material is dried and, if necessary, heat-treated at an elevated temperature.

When the coating procedure is applied, the porous polyester fiber may be in the form of a fiber mass, tow, silver, filament yarn, spun yarn, non-woven fabric, woven fabric, knitted fabric, net, or other textile material.

The coating layer is effective for enhancing the brilliance and/or color depth of the dyed polyester fiber composite structure. Since the peripheral surface of the porous polyester fiber substrate is roughened due to the number of fine pores formed in the fiber, the degree of specular reflection of light on the surface of the fiber becomes small. This phenomenon is effective for enhancing the brilliance and/or color depth of the dyed porous polyester fiber. Also, the coating layer having a smaller refractive index than that of the porous polyester fiber is effective for increasing the quantity of light absorbed by the dyed polyester fiber composite structure and, therefore, for enhancing the color depth thereof. That is, the excellent enhancing effect in the brilliance and/or color depth of the dyed polyester fiber composite structure of the present invention is derived from the sum of the color depth enhancing effect of the finely roughed surface of the porous polyester fiber substrate and the color depth enhancing effect of the coating layer having a small refractive index. The effect of the present invention is significant especially in the case where the porous polyester fiber is dyed a very deep color.

Also, the coating layer is effective for increasing the resistance of the porous polyester fiber to abrasion and fibril-formation, and therefore, for preventing change in hue and gloss of the dyed polyester fiber composite structure by abrassion applied thereto.

Furthermore, the coating layer has an excellent resistance to washing because a portion of the coated polymeric material penetrates into the pores in the polyester fiber substrate so as to form anchors inside the substrate.

The coating layer is preferably in an amount of from 0.3% to 30% based on the weight of the dyed porous polyester fiber.

The following specific examples are presented for the purpose of clarifying the present invention. However, it should be understood that these examples are intended only to illustrate the present invention and not to limit the scope of the present invention in any way.

In the examples, the color depth (strength) is represented by the value K/S calculated in accordance with the KubelkaMunk's equation:

$$K/S = \frac{(1-R)^2}{2R}$$

wherein K represents a light absorption coefficient, S represents a light scattering coefficient, and R represents a spectral reflectance at a wavelength of 500 millimicrons.

The spectral reflectance was measured by using a self-recording spectrophotometer.

The resistance to abrasion was determined by using a flat rubbing tester in such a manner that the specimen to be tested was rubbed with a rubbing fabric consisting of 100% polyethylene terephthalate fiber georgette crape under a load of 500 g. The change in color of the rubbed specimen was evaluated by using a Japanese Industrial Standard gray scale for color change. The degree of rubbing resistance was represented in the following manner.

| Class | Note |
|---|---|
| 1 | Very poor resistance |
| 2 | Poor resistance |
| 3 | Ordinary |
| 4 | Satisfactory resistance |
| 5 | Excellent resistance |

In practical use, it is necessary that the dyed polyester fiber specimen exhibit class 4 or 5 resistance to rubbing.

The size of the fine pores was determined by using an electron microscope at a magnification of 3000.

EXAMPLE 1

(1) Preparation and dyeing of porous polyester fibers

An ester interchange reaction vessel was charged with 100 parts by weight of dimethyl terephthalate, 60 parts by weight of ethylene glycol, and 0.06 parts by weight of calcium acetate monohydrate which corresponded to 0.066 molar % based on the molar amount of the dimethyl terephthalate. The reaction mixture was heated from 140° C. to 230° C. over a time of 4 hours in a nitrogen atmosphere while eliminating the generated methyl alcohol from the vessel.

The resultant ester interchange reaction product was mixed with 0.88 parts by weight of calcium acetate monohydrate (which corresponds to 0.970 molar % based on the molar amount of the dimethyl terephthalate) and 5 minutes after, with 0.35 parts by weight of phosphoric acid (which corresponds to 0.693 molar % based on the molar amount of the dimethyl terephthalate) and, further 5 minutes after, with 0.06 parts by weight of antimony trioxide.

The reaction mixture was placed in a polycondensation vessel. The pressure in the vessel was reduced from 760 mmHg to 1 mmHg over one hour and concurrently the temperature of the reaction mixture was elevated from 230° C. to 285° C. over 1.5 hours. The reaction mixture was heated at a temperature of 285° C. under a reduced pressure of 1 mmHg for 3 hours, to provide a polyester resin having an intrinsic viscosity of 0.646 and a softening point of 262° C. The resultant polymer resin was pelletized and the resultant polyester resin pellets were dried in a usual manner.

The polyester resin pellets were subjected to a melt-spinning process in which a spinneret having 36 spinning orifices each having a circular hole with a diameter of 0.3 mm was used, to produce undrawn multifilaments having a yarn count of 328 denier/36 filaments. The undrawn multifilaments were drawn at a draw ratio in a conventional manner to provide drawn multifilaments having a yarn count of 73 denier/36 filaments.

The drawn multifilament yarn was hard twisted and converted to a plain weave fabric having a weight of approximately 100 g/m$^2$. The fabric was scoured and then, pre-heat set in accordance with a usual method.

Thus pre-heat set fabric was treated with an aqueous solution containing 3.5% by weight of sodium hydroxide at a boiling temperature of the solution to an extent that 20% by weight of the original weight of the fabric was dissolved in the sodium hydroxide solution.

The size of the fine pores formed in the polyester fibers is indicated in Table 1. The polyester fibers in the fabric exhibited a refractive index of 1.537.

The alkali-treated fabric was dyed with 15% by weight of Diamix Black HG-FS (a trademark of disperse dye made by Mitsubishi Kasei Kogyo K. K.) based on the weight of the fabric, at a temperature of 130° C. for 60 minutes. The dyed fabric was reduction-washed with an aqueous solution containing 1 g/l of sodium hydroxide and 1 g/l of sodium hydrosulfite at a temperature of 70° C. for 20 minutes. A black-dyed fabric was obtained.

The color depth (strength) of the dyed fabric is indicated in Table 1.

TABLE 1

| Example No. | Pore-forming agent: Pentavalent phosphorus compound: Type | Amount (molar % based on DMT molar amount) | Calcium compound: Type | Stage of addition | Amount (molar ratio to pentavalent phosphorus compound) |
|---|---|---|---|---|---|
| Example | | | | | |
| 1 | Phosphoric acid | 0.693 | Ca—acetate | Before and after EI | 1.5 |
| 2 | " | " | " | " | 1.1 |
| 3 | Trimethyl phosphate | " | " | " | 1.5 |
| 4 | Reaction product of trimethyl phosphate with EG | " | " | " | " |
| Comparative Example | | | | | |
| 1 | Phosphoric acid | 0.45 | " | " | 1.5 |
| 2 | " | 0.693 | " | " | 1.0 |
| 3 | " | " | " | " | 1.75 |
| 4 | Phosphoric acid | 0.693 | Ca—acetate (Preliminary reaction product) | — | 1.5 |

| Example No. | Reduction (%) by alkali treatment | Porous polyester fiber: Size of pore: Width (μ) having largest distribution frequency | Length (μ) having largest distribution frequency | Color depth (K/S) | Change in color after 200 times rubbings | Coated porous polyester fiber: Color depth (K/S) | Change in color after 200 times rubbings |
|---|---|---|---|---|---|---|---|
| Example | | | | | | | |
| 1 | 20 | 0.25 | 0.4 | 25.3 | none | 34.7 | none |
| 2 | " | 0.3 | 0.8 | 24.0 | none | 32.3 | none |
| 3 | " | 0.15 | 0.7 | 25.3 | none | 34.7 | none |
| 4 | " | 0.3 | 0.6 | 22.8 | none | 32.3 | none |
| Comparative Example | | | | | | | |
| 1 | 20 | 0.17 | 0.3 | 19.8 | none | 24.0 | none |
| 2 | " | 0.6 | 1.5 | 19.8 | slight | 24.0 | none |
| 3 | " | 1 | 3 | 18.6 | remarkable | 22.8 | slight |
| 4 | " | 1 | 3 | 18.6 | remarkable | 22.8 | slight |

(Note)
DMT: Dimethyl terephthalate
ET: Ester interchange reaction
EG: Ethylene glycol The dyed fabric was subjected to an abrasion test in which the fabric was rubbed 200 times. No change in color was found.

(2) Preparation of polymeric coating emulsion

A mixture of 30 g of dimethyl polysiloxane having a viscosity of 1000 CS measured at 25° C., 2 g of tall oil fatty acid containing basic oleic acid, 0.5 g of a 28% aqueous ammonia solution, 0.75 g of triethanolamine, and 66.75 g of water was agitated in a homogenizer to prepare an aqueous emulsion.

(3) Coating of the dyed fabric with the aqueous emulsion

The black dyed fabric was immersed in the aqueous emulsion which contained 5 g of solid substances, 2 g of glacial acetic acid, and 300 g of water was squeezed so that the fabric was impregnated with the aqueous emulsion in an amount of 75% based on the weight of the fabric. The impregnated fabric was dried and then, heat set at a temperature of 160° C. for one minute.

The color depth of the resultant dyed polyester fiber composite structure is indicated in Table 1. After the fabric was rubbed 200 times in the abrasion test, no change in color was found. The coating layer exhibited a refractive index of 1.403.

EXAMPLE 2

The same procedures as those described in Example 1 were carried out, except that after the ester interchange reaction was completed, calcium acetate monohydrate was added in an amount of 0.64 parts by weight, which corresponds to 0.705 molar % based on the molar amount of the dimethyl terephthalate. The refractive index of the porous polyester fibers was 1.537. The results are indicated in Table 1.

EXAMPLE 3

The same procedures as those described in Example 1 were carried out except that phosphoric acid was replaced by 0.5 parts by weight of trimethyl phosphate which corresponds to 0.693 molar % based on the molar amount of dimethyl terephthalate used. The refractive index of the porous polyester fibers was 1.537. The results are shown in Table 1.

EXAMPLE 4

(1) Preparation and dyeing of porous polyester fibers

The same procedures for preparing and dyeing porous fibers as those described in Example 1 were carried out, except that phosphoric acid was replaced by a reaction product of 0.5 parts by weight of trimethyl phosphate, which corresponds to 0.693 molar % based on the molar amount of dimethyl terephthalate used, with 1.5 parts by weight of ethylene glycol at a temperature of 140° C. for 6 hours. The refractive index of the porous polyester fibers was 1.537. The results are indicated in Table 1.

(2) Preparation of polymeric coating emulsion

A 200 ml stainless steel autoclave was charged with 200 g of deionized water, 1.1 g of ammonium persulfuric acid and 0.15 g of emulsifying agent consisting of ammonium perfluoro-n-octanate while flowing a protecting gas consisting of nitrogen through the autoclave. The autoclave was closed and the reaction mixture was cooled in a dry ice-acetone cooling bath. The pressure in the autoclave was reduced to 1 mmHg. Next, 40 g of tetrafluoroethylene and 20 g of propylene were introduced into the autoclave.

The reaction mixture in the autoclave was heated at a temperature of 80° C. for 8 hours while shaking the autoclave so as to copolymerize the tetrafluoroethylene and propylene.

Thereafter, the reaction mixture was cooled to room temperature. An aqueous emulsion containing 20% by dry solid weight of tetrafluoroethylene-propylene copolymer was obtained.

(3) Coating of dyed polyester fabric

The black dyed polyester fabric was impregnated with 80%, based on the weight of the fabric, of the polymeric coating emulsion, dried, and, then, heat set in 160° C. for one minute. The refractive index of the coating layer was 1.325. The results are shown in Table 1.

EXAMPLES 1 THROUGH 3

In each of Comparative Examples 1 to 3, the same procedures as those described in Example 1 were carried out except that the amounts of calcium acetate monohydrate and phosphoric acid added to the reaction mixture after the ester interchange reaction was completed, were as indicated in Table 1. The results are indicated in Table 1.

COMPARATIVE EXAMPLE 4

The same procedures as those described in Example 1 were carried out with the exception that the calcium acetate monohydrate and the phosphoric acid added to the reaction mixture after the ester interchange reaction was completed were replaced by an aqueous slurry.

The aqueous slurry was produced in the following manner. A high speed dispersing apparatus, equipped with stirring paddles having an outer diameter of 28 mm and an outer tube having an inner diameter of 29 mm and produced by Silverson Machine Co., U.K. as a laborating mixer-emulsifier, was charged with 100 parts by weight of a 56% phosphoric acid aqueous solution and 3250 parts by weight of a solution containing 4% by weight of calcium acetate monohydrate dissolved in ethylene glycol. The mixture was agitated at a high rotating number of 5000 rpm for 60 minutes. When the agitating procedure was completed, the temperature of the resultant slurry reached 70° C. In the slurry, calcium phosphate was uniformly dispersed in the form of fine particles mostly having a size of 0.3 microns or less. The slurry was kept standing at room temperature for 72 hours so as to allow coarse particles to settle. The settled coarse particles were removed from the slurry. The slurry was used in an amount corresponding to the amounts of the calcium acetate monohydrate and the phosphoric acid used in Example 1.

The results are indicated in Table 1.

EXAMPLE 5

(1) Preparation and dyeing of porous polyester fibers

The same ester interchange reaction procedures as those described in Example 1 were carried out except that calcium acetate monohydrate was replaced by 0.08 parts by weight of magnesium acetate tetrahydrate, which corresponded to 0.072 molar % based on the molar amount of dimethyl terephthalate used.

The reaction product was mixed with 0.74 parts of magnesium acetate tetrahydrate, which corresponded to 0.720 molar % based on the molar amount of dimethyl terephthalate used, and 5 minutes thereafter, with 0.30 parts by weight of phosphorous acid which corresponded to 0.710 molar % based on the molar amount of dimethyl terephthalate used, and 5 minutes thereafter, with 0.04 parts by weight of antimony trioxide. The reaction mixture was placed in a polycondensation vessel and subjected to the same polycondensation procedure as those described in Example 1.

The resultant polyester resin exhibited an intrinsic viscosity of 0.643, a softening temperature of 262° C., and a hue of Col-L70, Col-b10. The polyester resin was pelletized in a usual manner.

The polyester resin pellets were subjected to the same melt-spinning and drawing procedures as those described in Example 1.

The resultant polyester fibers were converted to a plain weave fabric having a weight of 80 g/m$^2$.

The polyester fiber fabric was subjected to the same alkali treatment as that described in Example 1.

The size of the fine pores formed in the polyester fibers is indicated in Table 2. The porous polyester fibers exhibited a refractive index of 1.537.

The alkali-treated fabric was dyed black in the same manner as that described in Example 1, except that the dyed fabric was reduction washed with an aqueous solution containing 2 g/l of sodium hydrosulfite at a temperature of 80° C. for 20 minutes.

The color depth (K/S value determined at a wavelength of 500 millimicrons) of the dyed fabric is indicated in Table 2.

(2) Preparation of polymeric coating emulsion

The same procedures as those described in Example 1 were carried out.

(3) Coating of dyed porous polyester fiber fabric

The same coating procedures as those described in Example 1 were applied to the dyed porous polyester fiber fabric. The color depth and resistance to rubbing of the resultant dyed polyester fiber composite structure are indicated in Table 2.

TABLE 2

| Example No. | Trivalent phosphorus compound | | Alkaline earth metal compound | | |
|---|---|---|---|---|---|
| | Type | Amount (molar % based on DMT) | Type | Stage of addition | Amount (molar ratio to trivalent P-compound) |
| Example 5 | Phosphorous acid | 0.71 | Mg—acetate | Before and after EI | 1.05 |

TABLE 2-continued

| | | | | | |
|---|---|---|---|---|---|
| 6 | " | " | " | " | 1.49 |
| 7 | Triethyl phosphite | " | " | " | 1.05 |
| 8 | Triphenyl phosphite | " | " | " | " |
| 9 | Phosphorous acid | " | Mg—acetate/ Ca—acetate | " | " |
| Comparative Example | | | | | |
| 5 | " | 0.45 | Mg—acetate | " | 1.05 |
| 6 | " | 0.71 | " | " | 0.95 |
| 7 | " | " | " | " | 1.75 |

| | | Porous polyester fiber | | | | Coated porous polyester fiber | |
|---|---|---|---|---|---|---|---|
| | | Size of pore | | | | | |
| Example No. | Reduction in weight by alkali treatment (%) | Size of pores having largest distribution frequency (μ) | Thickness of pore-containing surface layer (μ) | Color depth (K/S) | Resistance to rubbing (Class) | Color depth (K/S) | Resistance to rubbing (Class) |
| Example | | | | | | | |
| 5 | 20 | 0.3 | 1.0 | 22.8 | 4 | 30.3 | 4–5 |
| 6 | " | 0.2 | 1.0 | 24.0 | 4 | 32.3 | 4–5 |
| 7 | " | 0.2 | 0.8 | 24.2 | 4 | 34.7 | 4 |
| 8 | " | 0.2 | 0.8 | 24.0 | 4 | 32.3 | 4–5 |
| 9 | " | 0.3 | 1.5 | 22.8 | 4 | 30.3 | 4–5 |
| Comparative Example | | | | | | | |
| 5 | " | 0.1> | 0.3 | 18.6 | 4–5 | 22.8 | 4–5 |
| 6 | " | 0.6 | 2 | 18.6 | 3 | 22.8 | 4 |
| 7 | " | 0.1> | 0.3 | 18.6 | 4–5 | 22.8 | 4–5 |

EXAMPLE 6

The same procedures as those described in Example 5 were carried out except that magnesium acetate tetrahydrate was added in an amount of 1.09 parts by weight, corresponding to 0.987 molar % based on the molar amount of dimethyl terephthalate used, to the reaction mixture after the ester interchange reaction was completed. The results are shown in Table 2.

EXAMPLE 7

The same procedures as those described in Example 5 were carried out, except that phosphorous acid was replaced by triethyl phosphite in an amount of 0.607 parts by weight corresponding to 0.710 molar % based on the molar amount of dimethyl terephthalate used. The results are shown in Table 2.

EXAMPLE 8

The same procedures as those described in Example 1 were carried out, except that phosphorous acid was replaced by triphenyl phosphite in an amount of 1.135 parts by weight, corresponding to 0.710 molar % based on the molar amount of dimethyl terephthalate used. The results are shown in Table 2.

EXAMPLE 9

The same procedures as those described in Example 5 were carried out, except that the magnesium acetate tetrahydrate, added to the reaction mixture after the ester interchange reaction was completed, was replaced by calcium acetate monohydrate in an amount of 0.61 parts by weight, which corresponded to 0.672 molar % based on the molar amount of dimethyl terephthalate used. The results are shown in Table 2.

COMPARATIVE EXAMPLES 5 THROUGH 7

In each of the Comparative Examples 5 to 7, the same procedures as those described in Example 5 were carried out, except that the amounts of magnesium acetate tetrahydrate and phosphorous acid, added to the reaction mixture after the ester interchange reaction was completed, were changed to those indicated in Table 2. The results are shown in Table 2.

EXAMPLES 10, 11, AND 12

In each of Examples 10, 11, and 12, the same procedures as those described in Example 1 were carried out with the following exceptions.

1. After the ester interchange reaction was completed, the resultant product was mixed with 9.736 parts of a clear solution containing a calcium phosphorous diester and calcium acetate and then with 0.04 parts by weight of antimony trioxide.

The above-mentioned clear solution was prepared by the following method. Triethyl phosphite in an amount of 0.5 parts by weight, corresponding to 0.585 molar % based on the molar amount of dimethylol terephthalate used, was reacted with calcium acetate monohydrate in an amount of 0.265 parts by weight, corresponding to 50 molar % based on the molar amount of triethyl phosphite used, in 8.5 parts by weight of ethylene glycol at a temperature of 120° C. for 60 minutes while refluxing. The resultant clear solution containing calcium phosphorous diester and in an amount of 9.265 parts by weight dissolved therein calcium acetate monohydrate in an amount of 0.471 parts by weight, corresponding to 88.8 molar % based on the molar amount of triethyl phosphite used, at room temperature. A clear solution was obtained.

2. The resultant polyester resin exhibited an intrinsic viscosity of 0.638, a softening point of 258° C., and contained therein 0.4% of the pore-forming agent particles.

3. In the drawing process, the draw ratio was 3.5 and the resultant filaments had a yarn count of 75 deniers/36 filaments.

4. A half portion of the drawn multifilament yarn was hard twisted at a S twist number of 2500 T/m and the remaining portion of the drawn multifilament yarn was based twisted at a Z twist number of 2500 T/m. The hard twisted yarns were heat set with steam at a temperature of 80° C. for 30 minutes.

5. The heat set yarns were converted to a georgette fabric having a warp density of 47 yarns/cm and a weft density of 32 yarns/cm. In the warps and wefts in the fabric, every two S-twisted yarns and every two Z-twisted yarns were alternately arranged.

The fabric was subjected to a relaxing process by using a rotary washer at a boiling temperature for 20 minutes so as to convert the fabric to a crepe fabric.

6. The crepe fabric was subjected to the same alkali treatment as that described in Example 1, except that the reduction in weight of the fabric was 10% in Example 10, 20% in Example 11, and 30% in Example 12.

7. In Example 11, the dyed porous polyester fiber was observed through an electron microscope at a magnification of 10,000. It was found that the average sizes of the primary particles of the pore-forming agent dispersed in the fiber were less than 100 microns and the number of secondary aggregate particles having a size of 100 microns or more was 0.3 per 10 square microns of the cross-sectional area of the fiber. The results are indicated in Table 3.

COMPARTIVE EXAMPLES 8, 9, AND 10

In Comparative Examples 8, 9, and 10, the same procedures as those described respectively in Examples 10, 11, and 12 were carried out, with the following exceptions.

1. In the preparation of the clear solution containing calcium phosphorous diester and calcium acetate, to be added to the reaction mixture after the ester interchange reaction, the amount of calcium acetate monohydrate to be added at room temperature was changed to 0.63 parts by weight, which corresponded to a molar amount of 1.187 times the molar amount of triethyl phosphite used.

2. The resultant polyester resin exhibited an intrinsic viscosity of 0.640 and a softening point of 259° C. and contained the pore-forming agent in an amount of 0.6% by weight.

3. The dyed porous polyester fiber contained therein approximately five secondary aggregate particles of the pore-forming agent having a size of 100 microns or more, per 10 square microns of the cross-sectional area of the fiber.

The results are shown in Table 3.

TABLE 3

| | Pore-forming agent | | | | Dyed, alkali-treated polyester fabric | | | | Coated polyester fiber | |
|---|---|---|---|---|---|---|---|---|---|---|
| | Phosphorus compound | | | | | | | | | |
| Example No. | Type | Amount (molar % based on DMT) | Type of alkaline earth metal compound | Molar ratio of Ca-compound/ P-compound | Reduction in weight (%) | Number of secondary aggregate particles per 10 $\mu^2$ | Color depth (K/S) | Change in color by 200 times of rubbings (Class) | Color depth (K/S) | Change in color by 200 times of rubbings (Class) |
| Example | | | | | | | | | | |
| 10 | Ca—phosphorous diester | 0.585 | Ca—acetate | 1.5 | 10 | — | 26.1 | 5 | 32.4 | 5 |
| 11 | Ca-phosphorous diester | " | " | " | 20 | 0.3 | 26.0 | 4–5 | 32.4 | 4–5 |
| 12 | Ca-phosphorous diester | " | " | " | 30 | — | 26.1 | 4 | 32.4 | 4–5 |
| Comparative Example | | | | | | | | | | |
| 8 | Ca-phosphorous diester | 0.585 | " | 1.8 | 10 | — | 23.0 | 4 | 28.8 | 4 |
| 9 | Ca-phosphorous diester | " | " | " | 20 | 5.0 | 23.5 | 3–4 | 29.0 | 4 |
| 10 | Ca-phosphorous diester | " | " | " | 30 | — | 24.3 | 3–4 | 29.0 | 3–4 |

EXAMPLE 13

(1) Preparation of polyester resin

The same procedures as those described in Example 1 were carried out, with the following exceptions.

A. After the ester interchange reaction was completed, the reaction product was mixed with anhydrous lithium acetate in an amount of 0.64 parts by weight, which corresponded to 1.88 molar % based on the molar amount of dimethyl terephthalate used, 5 minutes thereafter, with phosphoric acid in an amount of 0.35 parts by weight, which corresonded to 0.69 molar % based on the molar amount of dimethyl terephthalate used, and 5 minutes thereafter, with 0.04 parts by weight of antimony trioxide.

B. After the reaction mixture was placed in a polycondensation vessel, to the reaction mixture was added the sodium salt of 3,5-di($\beta$-hydroxyethoxycarbonyl) benzene sulfonic acid in an amount of 4.8 parts, which corresponded to 2.6 molar % based on the molar amount of dimethyl terephthalate used.

C. The polycondensation was carried out at a temperature of 280° C.

D. The resultant polyester resin exhibited an intrinsic viscosity of 0.512 and a softening point of 258° C.

(2) Preparation of dyed porous polyester fiber fabric

The same procedures as those described in Example 1 were carried out with the following exceptions.

A. The melt-spinning procedure was carried out at a temperature of 290° C., and the drawing procedure was carried out at a draw ratio of 3.5. The resultant drawn multifilament yarn had a yarn count of 75 deniers/36 filaments.

B. The drawn filaments yarn was subjected to the same hard twisting procedure as that described in Example 10 and the resultant hard twisted yarns were subjected to the same weaving procedur as that described in Example 10. Thereafter, the resultant fabric was subjected to the same relaxing and heat setting procedures as those described in Example 10.

C. The resultant crepe fabric was treated with an aqueous solution containing 1% by weight of sodium hydroxide at the boiling temperature of the solution until 20% of the original weight of the fabric was dissolved in the solution.

D. A portion of the alkali-treated fabric was dyed blue with a disperse dye-dyeing liquor containing:

| | |
|---|---|
| Resolin Blue FBL | 4% owf |
| Disper VG | 0.5 g/l |
| Acetic acid | 0.2 g/l |

at a liquor ratio of 1:30 at a temperature of 130° C. for 60 minutes. Another portion of the fabric was dyed blue with a cationic dye-dyeing liquor containing:

| | |
|---|---|
| Aizen Cathilon Blue CD-FBLH | 2% owf |
| Sodium sulfate | 2 g/l |
| Acetic acid | 0.5 g/l |

at a liquor ratio of 1:30 at a temperature of 120° C. for 60 minutes.

The other portion of the fabric was dyed black with a cationic dye-dyeing liquor containing:

| | |
|---|---|
| Aizen Cathilon Block CD-GLH | 8% owf |
| Sodium sulfate | 2 g/l |
| Acetic acid | 0.5 g/l |

under the same conditions as described above.

E. The color depth and rubbing resistance of the black-dyed fabric are indicated in Table 4.

The brilliance of the blue dyed fabrics was determined by naked eye-observation in accordance with the following classification:

| Class | Brilliance |
|---|---|
| 5 | Excellent |
| 4 | Good |
| 3 | Standard |
| 4 | Poor |
| 5 | Very poor |

TABLE 4

| Example No. | Pore-forming agent: Amount of Li—acetate (part) | Phosphorus compound: Type | Phosphorus compound: Amount (part) |
|---|---|---|---|
| Example 13 | 0.64 | Phosphoric acid | 0.35 |
| Comparative Example 11 | 0.14 | Phosphoric acid | 0.10 |
| Example 14 | 1.95 | Phosphoric acid | 1.00 |
| Comparative Example 12 | 3.97 | Phosphoric acid | 2.00 |
| Example 15 | 0.64 | Trimethyl phosphate | 0.50 |
| Example 16 | 0.64 | Reaction product of trimethyl phosphate with ethylene glycol | 0.50 (in terms of trimethyl phosphate) |
| Example 17 | 0.42 | Reaction product of trimethyl phosphate with Li—acetate (molar ratio 1:1) | 0.50 (in terms of trimethyl phosphate) |
| Example 18 | 0.64 | Phosphorous acis | 0.29 |
| Example 19 | 0.64 | Phosphoric acid | 0.35 |
| Comparative Example 13 | — | Phosphoric acid | 0.04 |
| Comparative Example 14 | Ca—acetate | Phosphoric acid | 0.35 |

TABLE 4-continued

Example 14

| Example No. | Dyed fabric: Color depth of black fabric (K/S) | Brilliance of blue fabric: Disperse dye | Brilliance of blue fabric: Cationic dye | Change in color due to 200 times of rubbings (Class) |
|---|---|---|---|---|
| Example 13 | 26.9 | 4 | 4–5 | 4–5 |
| Comparative Example 11 | 22.5 | 2 | 3 | 5 |
| Example 14 | 26.8 | 4 | 4–5 | 4–5 |
| Comparative Example 12 | 26.9 | 4 | 4–5 | 3 |
| Example 15 | 27.0 | 4 | 4–5 | 4–5 |
| Example 16 | 27.0 | 4 | 4–5 | 4–5 |
| Example 17 | 27.0 | 4 | 4–5 | 4–5 |
| Example 18 | 25.7 | 2 | 4 | 4 |
| Example 19 | 26.8 | 4 | 4–5 | 4–5 |
| Comparative Example 13 | 22.5 | 2 | 3 | 4–5 |
| Comparative Example 14 | 20.4 | 1 | 2 | 4 |

| Example No. | Coated fabric: Color depth of black fabric (K/S) | Brilliance of blue fabric: Disperse dye | Brilliance of blue fabric: Cationic dye | Change in color due to 200 times of rubbings (Class) |
|---|---|---|---|---|
| Example 13 | 32.3 | 4–5 | 5 | 4–5 |
| Comparative Example 11 | 27.0 | 4 | 4–5 | 5 |
| Example 14 | 31.5 | 4–5 | 5 | 4–5 |
| Comparative Example 12 | 31.5 | 4–5 | 5 | 3–4 |
| Example 15 | 32.3 | 4–5 | 5 | 4–5 |
| Example 16 | 32.3 | 4–5 | 5 | 4–5 |
| Example 17 | 32.3 | 4–5 | 5 | 4–5 |
| Example 18 | 30.8 | 4 | 4–5 | 4–5 |
| Example 19 | 31.5 | 4–5 | 5 | 4–5 |
| Comparative Example 13 | 27.5 | 4 | 4–5 | 4–5 |
| Comparative Example 14 | 25.08 | 4 | 4 | 4 |

(3) Preparation of polymeric coating emulsion and coating of the dyed porous polyester fiber fabric.

The same procedures as those described in Example 1 were carried out.

The results are shown in Table 4.

EXAMPLE 14 AND COMPARATIVE EXAMPLES 11 AND 12

The same procedures as those described in Example 13 were carried out, except that the amounts of anhydrous lithium acetate and phosphoric acid were changed to those shown in Table 4. The results are shown in Table 4.

EXAMPLES 15 THROUGH 18

In each of the Examples 15 to 18, the same procedures as those described in Example 13 were carried out, except that phosphoric acid was replaced by the phosphorus compound in the amount indicated in Table 4. The results are shown in Table 4.

EXAMPLE 19

The same procedures as those described in Example 13 were conducted with the following exceptions.

1. Before the ester interchange reaction was started, 4 parts by weight of, sodium salt of 3,5-di(carbomethoxy) benzene sulfonic acid were used in place of 4.8 parts by weight of sodium salt of 3,5-di-(β-hydroxyethoxycarbonyl)benzene sulfonic acid.

2. Before the ester interchange reaction was started, 0.06 parts by weight of anhydrous lithium acetate, which corresponded to 0.177 molar % based on the molar amount of dimethyl terephthalate used, were added to the reaction mixture and the remaining 0.58 parts by weight of anhydrous lithium acetate were added to the reaction mixture after the ester interchange reaction was completed.

The results are indicated in Table 4.

COMPARATIVE EXAMPLE 13

The same procedures as those described in Example 13 were carried out except that no anhydrous lithium acetate was used, and after the ester interchange reaction was completed, phosphoric acid was added in an amount of 0.04 parts by weight corresponding to 0.079 molar % based on the molar amount of dimethyl terephthalate used, to the reaction mixture.

The results are indicated in Table 4.

COMPARATIVE EXAMPLE 14

The same procedures as those described in Example 13 were carried out, except that anhydrous lithium acetate was replaced by calcium acetate monohydrate in an amount of 0.85 parts by weight, corresponding to 0.94 molar % based on the molar amount of dimethyl terephthalate used. The results are indicated in Table 4.

EXAMPLES 20, 21, AND 22

In each of Examples 20, 21, and 22, the same ester interchange procedures as those described in Example 1 were carried out with the following exceptions.

1. The ester interchange reaction product was mixed with (1) 9.88 parts by weight of a clear solution containing phosphoric diester calcium salt and calcium acetate, which solution was prepared by (a) reacting trimethyl phosphate in an amount of 0.5 parts by weight corresponding to 0.693 molar % based on the molar amount of dimethyl tetraphthalate used, with calcium acetate monohydrae in an amount of 0.31 parts by weight corresponding to ½ times the molar amount of trimethyl phosphate used, in 8.5 parts by weight of ethylene glycol at a temperature of 120° C. for 60 minutes while refluxing and (b) dissolving calcium acetate monohydrate in an amount of 0.57 parts by weight, corresponding to 90 molar % based on te molar amount of trimethyl phosphate used, in 9.31 parts of the resultant clear solution containing phosphoric diester calcium salt, at room temperature, and then with (2) 0.04 parts by weight of antimony trioxide.

2. The resultant polyester resin exhibited an intrinsic viscosity of 0.641 and a softening point of 259° C.

3. In the preparation of the polyester fibers, the melt-spinning temperature was 290° C., the draw ratio was 3.5, and the resultant multifilament yarn was of a yarn count of 75 deniers/36 filaments.

4. The multifilament yarn was converted to a georgette crepe fabric in the same manner as that described in Example 10, and the fabric was relaxed in the same manner as that described in Example 10.

5. The alkali treatment was applied to an extent that the reduction in weight was 10% in Example 20, 20% in Example 21, and 30% in Example 22, based on the original weight of the fabric.

The results are indicated in Table 5.

COMPARATIVE EXAMPLES 15, 16, AND 17

In Comparative Examples 15, 16, and 17, the same procedures as those described respectively in Examples 20, 21, and 22 were carried out with the following exceptions.

1. The clear solution containing phosphoric diester calcium salt and calcium acetate monohydrate was replaced by the white slurry containing phosphoric monoester calcium salt and calcium acetate monohydrate in an amount corresponding to the amount of calcium acetate monohydrate contained in the clear solution described in Example 20, 21, or 22. The white slurry was produced in the following manner.

2. The same high speed dispersing apparatus as that described in Comparative Example 4 was charged with a mixture containing 100 parts by weight of monomethyl phosphate and 3933 parts by weight of a solution containing 4% by weight of calcium acetate monohydrate dissolved in ethylene glycol, the molar amount of calcium acetate used being equal to the molar amount of monomethyl phosphate used. The mixture was subjected to a reaction at a temperature of 120° C. for 60 minutes while being stirred at a speed of 500 rpm.

The results are shown in FIG. 5.

TABLE 5

| | Pore-forming agent | | | | | | | Dyed fabric | | Coated fabric | |
|---|---|---|---|---|---|---|---|---|---|---|---|
| | Phosphorus compound | | Type of alkaline earth metal compound | Molar ratio of Ca-compound/P-compound | Reduction in weight (%) | Size of pores | | | | | |
| Example No | Type | Amount (molar % based on DMT) | | | | Width (μ) | Length (μ) | Color depth (K/S) | Change in color due to 200 times rubbings (Class) | Color depth (K/S) | Change in color due to 200 times rubbings (Class) |
| Example | | | | | | | | | | | |
| 20 | Phosphoric diester calcium salt | 0.693 | Ca-acetate | 1.5 | 10 | 0.1–0.2 | 0.1–0.3 | 25.7 | 5 | 30.2 | 5 |
| 21 | Phosphoric diester calcium salt | 0.693 | Ca-acetate | 1.5 | 20 | 0.1–0.3 | 0.1–0.4 | 26.0 | 4–5 | 31.3 | 4–5 |
| 22 | Phosphoric diester calcium salt | 0.693 | Ca-acetate | 1.5 | 30 | 0.1–0.3 | 0.1–0.45 | 26.0 | 4 | 31.3 | 4–5 |
| Comparative Example | | | | | | | | | | | |
| 15 | Phosphoric monoester | 0.693 | Ca-acetate | 1.5 | 10 | 0.1–0.5 | 0.2–0.7 | 20.7 | 2–3 | 24.7 | 3 |

TABLE 5-continued

| Example No | Pore-forming agent: Phosphorus compound: Type | Amount (molar % based on DMT) | Type of alkaline earth metal compound | Molar ratio of Ca-compound/P-compound | Reduction in weight (%) | Size of pores: Width (μ) | Length (μ) | Dyed fabric: Color depth (K/S) | Change in color due to 200 times rubbings (Class) | Coated fabric: Color depth (K/S) | Change in color due to 200 times rubbings (Class) |
|---|---|---|---|---|---|---|---|---|---|---|---|
| | dicalcium salt | | | | | | | | | | |
| 16 | Phosphoric monoester dicalcium salt | 0.693 | Ca-acetate | 1.5 | 20 | 0.2–0.6 | 0.3–1.0 | 19.8 | 2 | 22.8 | 2–3 |
| 17 | Phosphoric monoester dicalcium salt | 0.693 | Ca-acetate | 1.5 | 30 | 0.2–0.7 | 0.3–1.2 | 19.4 | 2 | 21.7 | 2–3 |

(Note)
DMT: Dimethyl terephthalate

We claim:

1. A dyed polyester fiber composite structure having an enhanced brilliance and color, produced by the process comprising:

(A) (1) forming a polyester resin by reacting a dicarboxylic acid component comprising at least one member selected from the group consisting of terephthalic acid and ester-forming derivative thereof as a principal ingredient thereof, with a glycol component comprising at least one alkylene glycol having 2 to 6 carbon atoms as a principal ingredient thereof to form a primary reaction mixture, and polycondensing the primary reaction mixture, in at least one stage of the polyester resin-forming procedure, admixing with the mixture at least one precursory pore-forming agent selected from the group consisting of:

(a) a mixture of at least one pentavalent phosphorus compound in an amount of 0.3 to 3 molar % based on the molar amount of said dicarboxylic acid component and at least one calcium compound which is in an amount of 1 mole to 1.7 moles per mole of said pentavalent phosphorus compound and which has not been preliminarily reacted with said pentavalent phosphorus compound;

(b) a mixture of at least one trivalent phosphorus compound in an amount of 0.3 to 3 mole % based on the molar amount of said dicarboxylic acid component, and at least one alkaline earth metal compound which is in an amount of 1 mole to 1.7 moles per mole of said trivalent phosphorus compound and which has not been preliminarily reacted with said trivalent phosphorus compound;

(c) a mixture of 0.3 to 3 molar % based on the molar amount of said dicarboxylic acid component, of at least one phophorus compound of the formula (I):

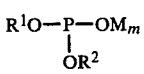

(I)

wherein $R^1$ and $R^2$ represent, independently from each other, a member selected from the group consisting of hydrogen and monovalent organic radicals, M represents a member selected from the group consisting of alkali metals and alkaline earth metals, and m represents 1 when M represents an alkali metal and $\frac{1}{2}$ when M represents an alkaline earth metal, and at least one alkaline earth metal compound in an amount of 0.5 to 1.2 moles per mole of said phosphorus compound of the formula (I) and which has not been preliminarily reacted with said phosphorus compound of the formula (I);

(d) a mixture of ingredients comprising (i) at least one member selected from the group consisting of isophthalic acid compounds having an alkali metal sulfonate radical and ester-forming derivatives thereof in an amount 0.5 to 10 molar % based on the molar amount of said dicarboxylic acid component, (ii) at least one phosphorus compound of the formula (II):

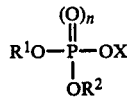

(II)

wherein $R^1$ and $R^2$ represent, independently from each other, a member selected from the group consisting of hydrogen and monovalent organic radicals, X represents a member selected from the group consisting of hydrogen, monovalent organic radicals and monovalent metal atoms, and n represents 0 or 1, in an amount of 0.3 to 3 molar % based on the molar amount of said dicarboxylic acid component, and (iii) at least one lithium compound in an amount such that the sum of the equivalent numbers of the metals contained in said ingredients (ii) and (iii) is in the range of from 2.0 times to 3.2 times the molar amount of the phosphorus compound in ingredient (ii), said ingredients (i), (ii), and (iii) not having been preliminarily reacted with each other; and (e) a mixture of 0.5 to 3 molar % based on the molar amount of said dicarboxylic acid component, of at least one phosphorus compound of the formula (III):

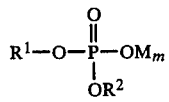

(III)

wherein $R^1$ and $R^2$ represent, independently from each other, a member selected from the group consisting of hydrogen and monovalent organic radicals, M represents a member selected from the group consisting of alkali metals and alkaline earth metals, and m represents 1 when M represents an alkali metal and ½ when M represents an alkaline earth metal, and at least one alkaline earth metal compound in an amount of from 0.5 to 1.2 moles per mole of said phosphorus compound of the formula (III) and which has not been preliminarily reacted with said phosphorus compound of the formula (III); whereby said precursory pore-forming agent is converted into a pore-forming agent dispersed in fine particle form in the resultant polyester resin, (2) melting spinning said resultant pore-forming agent-containing polyester resin to provide a polyester fiber in which fine particles of said pore-forming agent are dispersed, (3) treating said polyester fiber with an aqueous alkali solution to an extent that at least 2% of the weight of said polyester fiber is dissolved in said aqueous alkali solution, whereby a number of pores are formed in said polyester fiber, and (4) dying said resultant porous polyester fiber; and (B) coating said dyed porous polyester fiber with a composition comprising a polymeric material having a smaller refractive index than that of said porous polyester fiber.

2. A dyed polyester fiber composite structure as claimed in claim 1, wherein said porous polyester fiber has a number of fine pores formed therein and oriented in the direction of the longitudinal axis of said fiber, the width of said pores which is measured in the direction at right angles to the longitudinal axis of said fiber and has a largest distribution frequency thereof being in the range of from 0.1 to 0.5 microns and the length of said pores which is measured in a direction parallel to the longitudinal axis of the fiber and has a largest distribution frequency thereof being in the range of from 0.2 to 5 microns.

3. A dyed polyester fiber composite structure as claimed in claim 1, wherein said porous polyester fiber has a number of pores which are located at least in the peripheral surface layer having a thickness of 5 microns or more and which pores are oriented along the longitudinal axis of said fiber, and are connected to each other, the size of said pores having a largest distribution frequency thereof being in the range of from 0.1 to 0.5 microns.

4. A dyed polyester fiber composite structure as claimed in claim 1, wherein said polyester fiber contains 0.1% to 5% by weight of fine particles of said pore-forming agent having an average size of primary particle smaller than 100 millimicrons, the number of secondary aggregate particles of said pore-forming agent, having a size of 100 millimicrons or more, being not more than 3 per 10 square microns of the cross-sectional area of said fiber.

5. A dyed polyester fiber composite structure as claimed in claim 1, wherein said dicarboxylic acid component contains a small amount of an additional ingredient consisting of at least one member selected from the group consisting of dicarboxylic acids other than terephthalic acid and ester-forming derivatives thereof.

6. A dyed polyester fiber composite structure as claimed in claim 1, wherein said glycol component contains a small amount of an additional ingredient consisting of at least one other diol compound than the alkylene glycols.

7. A dyed polyester fiber composite structure as claimed in claim 1, wherein in said polyester resin-producing procedure, at least 80% by weight of said precursory pore-forming agent is admixed to said reaction mixture after said primary reaction is substantially completed but before the intrinsic viscosity of said reaction mixture in said polycondensation step reaches 0.3.

8. A dyed polyester fiber composite structure as claimed in claim 1, wherein in said mixture (a), said pentavalent phosphorus compound is selected from the group consisting of phosphoric acid, phosphoric mono-, di-, and tri-esters, condensed phosphoric acids, esters of the condensed phosphoric acids, and reaction products of the above-mentioned pentavalent phosphorus compound with at least one member selected from the group consisting of ethylene glycol and water.

9. A dyed polyester fiber composite structure as claimed in claim 1, wherein in said mixture (a), said calcium compound is selected from the group consisting of organic carboxylic calcium salts, inorganic calcium salts, calcium halides, calcium chelate compounds, calcium hydroxide, calcium oxide, calcium alcoholates, and calcium phenolate.

10. A dyed polyester fiber composite structure as claimed in claim 1, wherein in said mixture (a), said calcium compound is in an amount of 1.1 to 1.5 moles per mole of said pentavalent phosphorus compound.

11. A dyed polyester fiber composite structure as claimed in claim 1, wherein in said mixture (b), said trivalent phosphorus compound is selected from the group consisting of phosphorous acid, phosphorous mono-, di-, and tri-esters, and reaction products of the above-mentioned trivalent phosphorus compounds with at least one member selected from the group consisting of ethylene glycol and water.

12. The dyed polyester fiber composite structure as claimed in claim 1, wherein in said mixture (b), said alkaline earth metal compound is selected from the group consisting of organic carboxylic acid salts, and inorganic acid salts, halides, chelate compounds, hydroxides, oxides, alcoholates, and phenolates of alkaline earth metals and mixtures thereof.

13. A dyed polyester fiber composite structure as claimed in claim 1, wherein in said mixture (b), said alkaline earth metal compound is used in an amount of 1 to 1.5 moles per mole of said trivalent phosphorus compound.

14. A dyed polyester fiber composite structure as claimed in claim 1, wherein in said mixture (c), said monovalent organic radical represented by $R^1$ or $R^2$ in formula (I) is selected from the group consisting of alkyl radicals, aryl radicals, aralkyl radicals, and radicals of the formula $-(CH_2)_lO]_kR^3$ wherein $R^3$ represents a member selected from the group consisting of hydrogen, alkyl radicals, aryl radicals, and aralkyl radicals, l is an integer of 2 or more, and k is an integer of 1 or more.

15. A dyed polyester fiber composite structure as claimed in claim 1, wherein in said mixture (c), said alkaline earth metal compound is selected from the group consisting of organic carboxylic acid salts, inorganic acid salts halides, chelate compounds, hydroxides, oxides, alcoholates, and phenolates of alkaline earth metals and mixtures thereof.

16. A dyed polyester fiber composite structure as claimed in claim 1, wherein in said mixture (c), said alkaline earth metal compound is used in an amount of from 0.5 to 1.0 mole per mole of said phosphorus compound of formula (I).

17. A dyed polyester fiber composite structure as claimed in claim 1, wherein in said mixture (d), said alkali metal sulfonate radical-containing isophthalic acid compounds and ester-forming derivatives thereof are selected from the group consisting of sodium, 3,5-di(carboxy) benzene sulfonate, lithium 3,5-di(carboxy) benzene sulfonate, potassium 3,5-di(carboxy) benzene sulfonate, lithium 3,5-di(carbomethoxy) benzene sulfonate, potassium 3,5-di(carbomethoxy) benzene sulfonate, sodium 3,5-di(β-hydroxyethoxycarbonyl) benzene sulfonate, lithium 3,5-di(β-hydroxyethoxycarbonyl) benzene sulfonate, potassium 3,5-di(β-hydroxyethoxycarbonyl) benzene sulfonate, sodium 3,5-di(γ-hydroxypropoxycarbonyl) benzene sulfonate, sodium 3,5-di(δ-hydroxybutoxycarbonyl) benzene sulfonate, lithium 3,5-di(δ-hydroxybutoxycarbonyl) benzene sulfonate and mixtures thereof.

18. A dyed polyester fiber composite structure as claimed in claim 1, wherein in said mixture (d), said ingredient (i) is used in an amount of 1 to 6 molar % based on the molar amount of said dicarboxylic acid component.

19. A dyed polyester fiber composite structure as claimed in claim 1, wherein in said mixture (d), said phosphorus compound of formula (II) is selected from the group consisting of phosphoric acid, mono-, di-, and tri-esters of phosphoric acid, phosphorus acid, mono-, di-, and tri-esters of phosphorous acid, reaction products of the above-mentioned phosphorus compounds with at least one member selected from the group consisting of glycols and water and reaction products of equimolar amounts of the above-mentioned phosphorus compound with at least one lithium compound.

20. A dyed polyester fiber composite structure as claimed in claim 1, wherein in said mixture (d), said at least one lithium compound is selected from the group consisting of organic carboxylic acid salts, inorganic acid salts, halides, chelate compounds, hydroxides, oxides, alcoholates, and phenolates of lithium.

21. A dyed polyester fiber composite structure as claimed in claim 1, wherein in said mixture (e), the monovalent organic radical represented by $R^1$ and $R^2$ in the formula (III) is selected from the group consisting of alkyl radicals, aryl radicals, aralkyl radicals, and radicals of the formula $\text{-}(CH_2)_l O]_k R^3$, wherein $R^3$ represents a member selected from the group consisting of alkyl radicals, aryl radicals, and aralkyl radicals, l is an integer of 2 or more, and k is an integer of 1 or more.

22. A dyed polyester fiber composite structure as claimed in claim 1, wherein in said mixture (e), said alkaline earth metal compound is selected from the group consisting of organic carboxylic acid salts, inorganic acid salts, halides, chelate compounds, hydroxides, oxides, alcoholates, and phenolates of alkaline earth metals and mixtures thereof.

23. A dyed polyester fiber composite structure as claimed in claim 1, wherein said polyester fiber has a core-in-sheath structure in which the sheath is composed of a pore-forming agent-containing polyester resin and the core is composed of a polyester resin free from the pore-forming agent.

24. A dyed polyester fiber composite structure as claimed in claim 1, wherein said polyester fiber is drawn, heat-treated, textured, and converted into a yarn or fabric before the aqueous alkali solution treatment is applied thereto.

25. A dyed polyester fiber composite structure as claimed in claim 1, wherein said aqueous alkali solution contains 0.01% to 40% by weight of at least one member selected from the group consisting of sodium hydroxide, potassium hydroxide, tetramethylammonium hydroxide, sodium carbonate, potassium carbonate.

26. A dyed polyester fiber composite structure as claimed in claim 1, wherein said aqueous alkali solution treatment is carried out at a temperature of from room temperature to 130° C.

27. A dyed polyester fiber composite structure as claimed in claim 1, wherein in said aqueous alkali solution treatment, 2% to 50% by weight of said polyester fiber is dissolved in said solution.

28. A dyed polyester fiber composite structure as claimed in claim 1, wherein said coating layer exhibits a refractive index in the range of from 1.2 to 1.4 and being smaller than that of said porous polyester fiber.

29. A dyed polyester fiber composite structure as claimed in claim 1, wherein said coating layer comprises a polymeric material consisting of at least one member selected from the group consisting of fluorine-containing polymers, silicon-containing polymers, ethylene-vinyl acetate copolymers, polyacrylic and polymethacrytic esters, and polyurethanes.

30. A dyed polyester fiber composite structure as claimed in claim 29, wherein said fluorine-containing polymer is selected from the group consisting of polytetrafluoroethylene tetrafluoroethylene-propylene copolymers, tetrafluoroethylenehexafluoropropylene copolymers, tetrafluoroethylene-ethylene copolymers, tetrafluoroethylene-tetrafluoropropylene copolymers, polyfluorovinylidene, polypentadecafluorooctyl acrylate, polyfluoroethylacrylate, polytrifluoro-isopropyl methacrylate, and polytrifluoroethyl methacrylate.

31. A dyed polyester fiber composite structure as claimed in claim 29, wherein said silicon-containing polymer comprises at least one member selected from the group consisting of polydimethylsilane, polymethylhydrodiene siloxane, and polydimethyl siloxane.

32. A dyed polyester fiber composite structure as claimed in claim 1, wherein said coating layer is in an amount of from 0.3% to 30% based on the weight of said dyed porous polyester fiber.

33. A dyed polyester fiber composite structure as claimed in claim 1, wherein said coating layer is formed by coating said dyed porous polyester fiber with a fluid composition containing said polymeric material, drying the layer of said fluid composition heat-treating the dried coating layer.

34. A dyed polyester fiber composite structure of claim 1 wherein said polyester fiber contains said pore forming agent throughout.

35. A dyed polyester fiber composite structure of claim 1 comprising more than two layers of polyester wherein at least the outer layer comprises said pore-forming agent-containing polyester resin.

* * * * *